US011287112B2

(12) United States Patent
On et al.

(10) Patent No.: US 11,287,112 B2
(45) **Date of Patent: *Mar. 29, 2022**

(54) DECORATIVE LAMP AND MANUFACTURING METHOD THEREOF

(71) Applicant: Dongguan Kailang Industrial Co., Ltd., Dongguan (CN)

(72) Inventors: Chow Kwok On, Tai Po (CN); Huang Kailang, Dongguan (CN)

(73) Assignee: DONGGUAN KAILANG INDUSTRIAL CO., LTD., Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/864,930

(22) Filed: May 1, 2020

(65) Prior Publication Data

US 2021/0080086 A1 Mar. 18, 2021

(30) Foreign Application Priority Data

Sep. 17, 2019 (CN) ..... 201910875178.3
Sep. 17, 2019 (CN) ..... 201910875470.5

(51) Int. Cl.
*F21V 19/00* (2006.01)
*F21V 23/00* (2015.01)
(Continued)

(52) U.S. Cl.
CPC ..... *F21V 19/0025* (2013.01); *F21K 9/90* (2013.01); *F21V 23/002* (2013.01); *F21V 31/00* (2013.01);
(Continued)

(58) Field of Classification Search
CPC ..... F21W 2121/00; F21V 19/0005; F21V 19/0025; F21V 31/00; F21V 31/005; H01R 33/09; H01R 33/965
See application file for complete search history.

(56) References Cited

U.S. PATENT DOCUMENTS 4,244,014 A * 1/1981 Van Ess ..... F21V 21/0832 362/249.01
5,001,615 A 3/1991 Stefanelli
(Continued)

FOREIGN PATENT DOCUMENTS

CN 1624378 A 6/2005
CN 2919011 Y 7/2007
(Continued)

OTHER PUBLICATIONS

United States Patent Office Action for U.S. Appl. No. 16/742,379 dated Jun. 24, 2020 (11 pages).
(Continued)

*Primary Examiner* — Alan B Cariaso
(74) *Attorney, Agent, or Firm* — Michael Best & Friedrich LLP

(57) ABSTRACT

A decorative lamp includes a flexible mounting shell with a first end, a second end opposite the first end, a through hole extending through the first and second ends, a ridge extending into the through hole, and a first plurality of grooves. A light emitting body is positioned at least partially within the mounting shell, and the light emitting body extends through the second end of the mounting shell. A tail plug is positioned at least partially within the mounting shell adjacent the first end, and the tail plug includes a second plurality of grooves. The first plurality of grooves and the second plurality of grooves are aligned to form tracks configured to receive wires coupled to the light emitting body, and an outer surface of the mounting shell includes a stepped structure.

20 Claims, 3 Drawing Sheets

(51) Int. Cl.

| | |
|---|---|
| ***H01R 33/965*** | (2006.01) |
| ***F21V 31/00*** | (2006.01) |
| ***H01R 33/09*** | (2006.01) |
| ***F21W 121/00*** | (2006.01) |
| ***F21K 9/90*** | (2016.01) |
| *F21Y 115/10* | (2016.01) |

(52) U.S. Cl.
CPC ..... *H01R 33/09* (2013.01); *H01R 33/965* (2013.01); *F21V 19/0005* (2013.01); *F21W 2121/00* (2013.01); *F21Y 2115/10* (2016.08)

(56) References Cited

U.S. PATENT DOCUMENTS

| | | | | |
|---|---|---|---|---|
| 5,685,638 | A | 11/1997 | Huang | |
| 5,709,457 | A | 1/1998 | Hara | |
| 6,250,782 | B1 | 6/2001 | Huang | |
| 6,416,203 | B1 | 7/2002 | Fan Wong | |
| 6,719,441 | B2 | 4/2004 | Wong | |
| 6,921,180 | B2 | 7/2005 | Huang | |
| 8,388,213 | B2 | 3/2013 | Yu | |
| 9,803,851 | B2 | 10/2017 | Loomis et al. | |
| 10,584,865 | B2 | 3/2020 | Loomis et al. | |
| 2004/0017684 | A1 | 1/2004 | Huang | |
| 2006/0062020 | A1 | 3/2006 | Kuo | |
| 2008/0143234 | A1 | 6/2008 | Yu | |
| 2009/0251923 | A1* | 10/2009 | Yu | F21V 31/005 362/653 |
| 2009/0318027 | A1 | 12/2009 | Tseng | |
| 2010/0254161 | A1 | 10/2010 | Lu | |
| 2011/0122613 | A1* | 5/2011 | Hsu | H01R 33/72 362/231 |
| 2011/0221343 | A1 | 9/2011 | Kuo | |
| 2012/0033439 | A1 | 2/2012 | Liu et al. | |
| 2012/0113654 | A1 | 5/2012 | Dai | |
| 2013/0003390 | A1 | 1/2013 | Wu | |
| 2013/0322087 | A1 | 12/2013 | Tseng | |
| 2015/0204524 | A1* | 7/2015 | Pan | F21V 19/0025 313/318.01 |
| 2015/0211727 | A1 | 7/2015 | Loomis et al. | |
| 2020/0224867 | A1 | 7/2020 | Loomis et al. | |

FOREIGN PATENT DOCUMENTS

| | | | |
|---|---|---|---|
| CN | 101055064 | A | 10/2007 |
| CN | 201246726 | Y | 5/2009 |
| CN | 201335326 | Y | 10/2009 |
| CN | 101655227 | A | 2/2010 |
| CN | 202091877 | U | 12/2011 |
| CN | 109915791 | A | 6/2019 |
| CN | 209295040 | U | 8/2019 |

OTHER PUBLICATIONS

Chinese Patent Office Action for Application No. 201910051551.3 dated Mar. 4, 2020 (10 pages, English translation included).
United States Patent Office Action for U.S. Appl. No. 16/864,935 dated Nov. 20, 2020 (9 pages).
United States Patent Office Action for U.S. Appl. No. 16/742,379 dated Jan. 1, 2021 (17 pages).
United States Patent Office Action for U.S. Appl. No. 16/742,379 dated Apr. 21, 2021 (20 pages).
Chinese Patent Office Action for Application No. 201910051551.3 dated Jul. 10, 2020 (6 pages, statement of relevance included).
Chinese Patent Office Action for Application No. 201910051551.3 dated Oct. 21, 2020 (5 pages, statement of relevance included).
Chinese Patent Office Supplemental Search Report for Application No. 201910051551.3 dated Apr. 6, 2021 (1 page).
Chinese Patent Office Supplemental Search Report for Application No. 201910875178.3 dated Jul. 19, 2020 (1 page).
Chinese Patent Office Supplemental Search Report for Application No. 201910875470.5 dated Apr. 16, 2020 (1 page).
Chinese Patent Office Action for Application No. 201910875470.5 dated Apr. 26, 2020 (5 pages, statement of relevance included).
Chinese Patent Office Action for Application No. 201910875470.5 dated Sep. 9, 2020 (4 pages, statement of relevance included).

* cited by examiner

DECORATIVE LAMP AND MANUFACTURING METHOD THEREOF

CROSS-REFERENCE TO RELATED APPLICATIONS

This application claims priority to Chinese Patent Application No. 201910875470.5, filed Sep. 17, 2019, and to Chinese Patent Application No. 201910875178.3, filed Sep. 17, 2019, the entire contents of both of which are incorporated herein by reference.

FIELD

The disclosure relates to a technical field of lighting appliances, and in particular to a decorative lamp and a manufacturing method thereof.

BACKGROUND

Existing decorative lamps on the market may be classified into two types—a contact type and a welding type—according to the electrical connection form of the light emitting body or wick. The contact type has its main structure where the wire and the terminal on the lamp shell are connected together, and then a pin of the light emitting body is made to be in contact with a terminal to conduct electricity. If the light emitting body is damaged, the light emitting body may be easily removed and replaced with a new one. However, because the terminal and the pin of the light emitting body are not fixedly connected, the terminal or the pin tend to rust after long-term use or storage in humid environments. If the terminal is rusted, electrical conductivity is inhibited.

The welding type, which refers to that the wire and the pin of the lamp are welded together, is a form of direct electrical conduction. Because after the light emitting body and the wire are welded, the pin is still exposed, and some processing operations are required so that there is no contact between the pins. The processing operations may be roughly divided into four types, i.e., a shrink type, an injection molded type, a sealed type, and an embedded type, according to the different processing manners of the combination of the light emitting body and the wire after welding.

Shrink type processing includes placing an isolation component between two exposed pins to isolate the two exposed pins, and then a shrink sleeve made of a heat-shrinkable material is applied on the outer sides of the pins. The length of the shrink sleeve covers the pins and the exposed wire, and the shrink sleeve is shrunk under heat to tighten the wire and isolation component. It is difficult to automate the shrink type process, however, and the shrink type process is therefore typically used for small batch production.

During injection molded type processing, after the postures of the pin and the wire are adjusted, the pin and the wire are put into an injection mold to be injection molded so that the postures of the pin and the wire are fixed by the injection molded material.

During sealed type processing, the light emitting body is also injection molded so that the light emitting body and the exposed wire are completely sealed in the injection molded material.

Among the above-mentioned three processing manners, the shrink type is limited by the production process and the product quality level is variable, so it is most suitable for small batch machining and can hardly perform automated production. The injection molded type and the sealed type require use of expensive injection molding devices. Decorative lamps are typically inexpensive and may have only seasonal demand, so these costly methods are often infeasible.

SUMMARY

Thus, a need exists for a lamp that can be automatically assembled in the decorative lamp machining industry. The present disclosure provides a decorative lamp that is suitable for automated manufacturing and solves the above-mentioned technical problems.

Solving the above problems, the present disclosure provides, in one embodiment, a decorative lamp including a flexible mounting shell with a first end, a second end opposite the first end, a through hole extending through the first and second ends, a ridge extending into the through hole, and a first plurality of grooves. A light emitting body is positioned at least partially within the mounting shell, and the light emitting body extends through the first second end of the mounting shell. A tail plug is positioned at least partially within the mounting shell adjacent the first end of the mounting shell, and the tail plug includes a second plurality of grooves. The first plurality of grooves and the second plurality of grooves are aligned to form tracks configured to receive wires coupled to the light emitting body, and an outer surface of the mounting shell includes a stepped structure.

In some embodiments, the decorative lamp includes a lampshade coupled to the front face of the mounting shell.

In some embodiments, the isolation block includes a shape corresponding to a shape of the through hole, and the isolation block includes a groove for receiving a pin of the light emitting body.

In some embodiments, the light emitting body includes at least two pins, and wherein the track is a plurality of tracks, and wherein the amount of tracks is the equal to the amount of the wires.

The present disclosure provides, in another aspect, a method of manufacturing a decorative lamp that includes placing a mounting shell into a fixture, wherein the mounting shell includes a stepped structure, welding a plurality of wires to a corresponding plurality of pins of a light emitting body, placing an isolation column between the pins, inserting the light emitting body into a through hole of the mounting shell, such that a second end of the light emitting body protrudes from a second end of the mounting shell, positioning the light emitting body and the wires such that the wires align with a first plurality of grooves formed in the mounting shell, positioning a tail plug such that a second plurality of grooves formed in the tail plug is aligned with the wires, inserting the tail plug into the mounting shell through a first end of the mounting shell, by inserting the tail plug, pressing the wires into the first plurality of grooves, and further inserting the tail plug until the tail plug and the mounting shell cooperate to form a snap fit.

Embodiments of the present disclosure provides numerous advantages. For example, the stepped structure is convenient for positioning and clamping during production and manufacturing, and facilitates automation of production. The collar and the collar groove makes it convenient for mounting and removal of the tail plug and has a good fastening performance, and the design of the first wire groove and the second wire groove also enables the position where the wire is discharged to be sealed. The light emitting body is mounted in such a manner that the head passes through the mounting shell during the mounting of the light emitting body, which simplifies the mounting form, and the cost for automation transformation of the process is low. This is also convenient for automation transformation of a production line or device when adding other decorative components.

Other aspects of the disclosure will become apparent by consideration of the detailed description and accompanying drawings.

Figure 1:
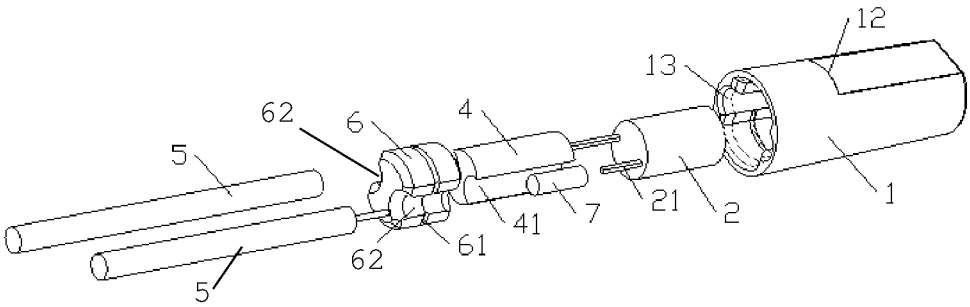
FIG. 1 is an exploded view of a lamp, according to an embodiment of the disclosure.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. It should be understood that the orientations or positional relationships indicated by the terms "upper", "lower", "front", "rear", "left", "right", "vertical", "horizontal", "top", "bottom", etc. are based on the orientations or positional relationships as shown in FIG. 1, and are only used for conveniently describing the disclosure and simplifying the descriptions, rather than indicating or implying that the devices or elements referred to must have specific orientations or be constructed and operated in specific orientations, and thus cannot be understood as limitations of the disclosure.

DETAILED DESCRIPTION

Figure 2:
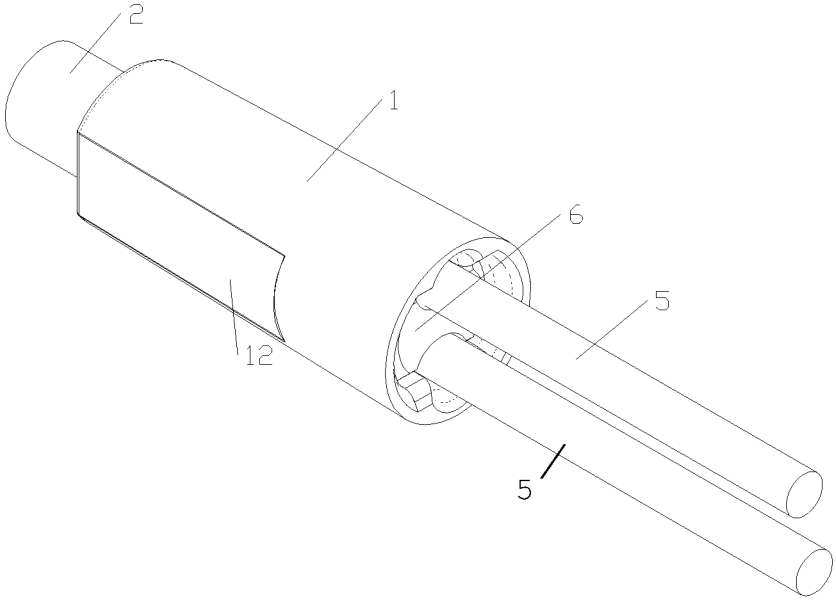
FIG. 2 is a perspective view of the lamp of FIG. 1.
Figure 3:
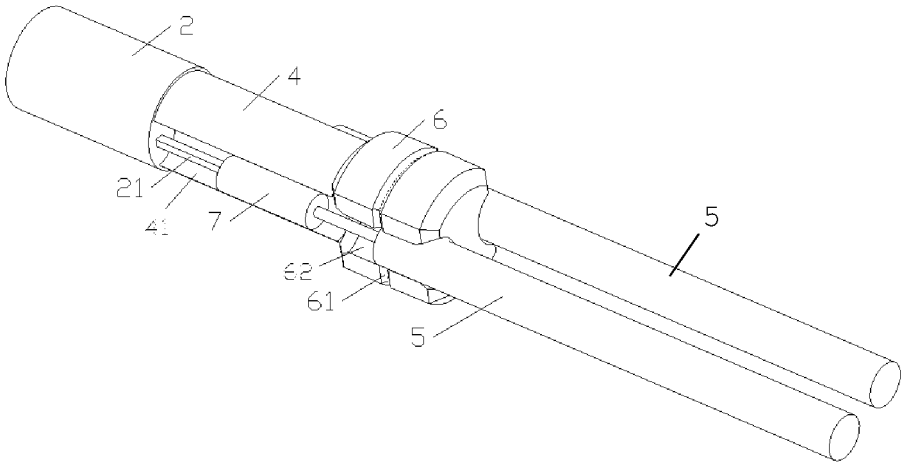
FIG. 3 is a perspective view of the lamp of FIG. 1, with a mounting shell is removed.
Figure 4:
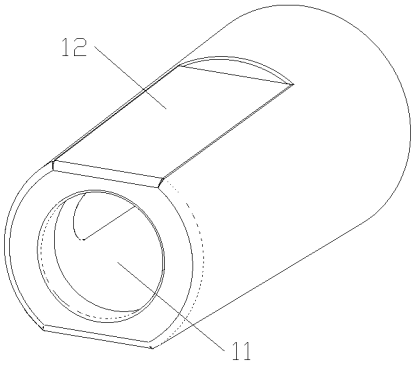
FIG. 4 is a front perspective view of the mounting shell of the lamp of FIG. 1.
Figure 5:
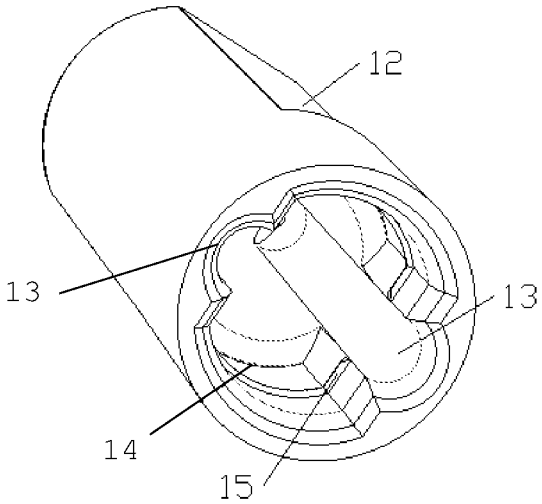
FIG. 5 is a rear perspective view of the mounting shell of FIG. 4.
Figure 6:
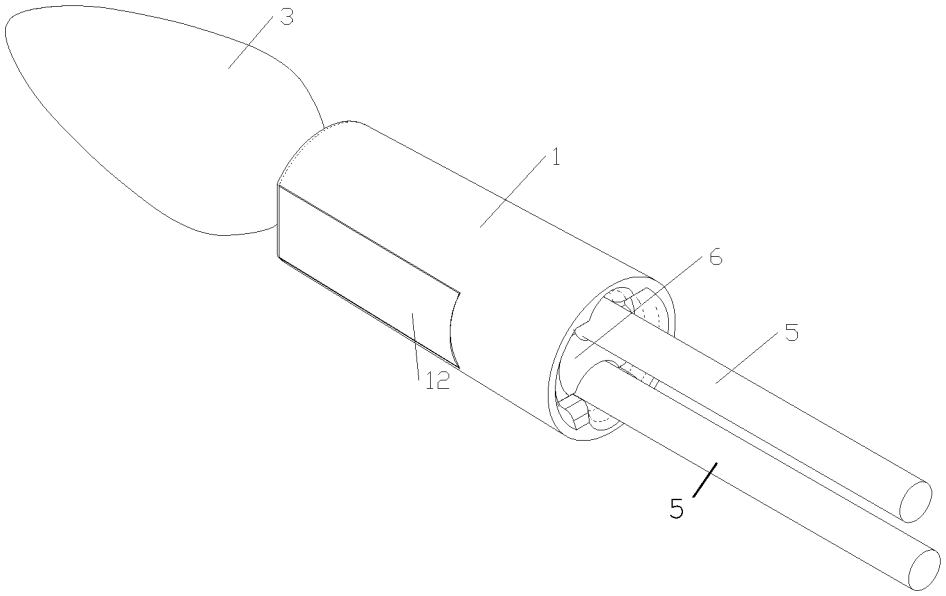
FIG. 6 is a perspective view of the lamp of FIG. 1, including a lampshade.

As shown in FIGS. 1-8, a decorative lamp according to an embodiment of the present disclosure includes a wick or light emitting body 2, a shell 1, and a decorative accessory 3 coupled to the shell 1 (FIGS. 2 and 6). The shell 1 includes a through hole 11 that extends through front and rear ends of the shell 1 so that the shell 1 forms a hollow structure (FIG. 4). The light emitting body 2 is provided at the front end of the shell 1 through the rear end of the shell 1 via the through hole 11, at the same time, the bottom of the light emitting body 2 is located within the through hole 11, and the remaining part extends out from the front end part of the shell 1 along the through hole 11.

Because the light emitting body 2 is inserted into the shell 1 from the rear end of the shell 1, the decorative accessory 3 and the shell 1 may be coupled together during assembly before the light emitting body 2 is inserted into the shell. This advantageously facilitates manufacturing and assembly of the decorative lamp.

As shown in FIG. 6, the shell 1 and the decorative accessory 3 are fixedly connected. In some embodiments, the decorative accessory 3 is tightly connected to the shell 1 through the front end of the shell 1 to form a matching structure for sealed engagement. The decorative accessory 3 may be a lampshade, diffuser, or a decorative piece provided at the front end of the light emitting body 2. The shape of the decorative piece may be, for example, an animal silhouette or another shape, and it may be fixed at an outer circumferential side of the front end of the shell 1, or fixed at a side of the front end of the shell 1 as long as it may play a decorative role.

Because the light emitting body 2 is mounted from the rear end of the shell 1, and part of the structure of the light emitting body 2 extends out from the front end of the shell 1, the connection between the decorative accessory 3 and the shell 1 does not affect the mounting of the light emitting body 2. This further facilitates the reduction of the assembly difficulty and the reduction of the number of the assembly steps.

In some embodiments, the shell 1 may be fixed by a clamping fixture or other jig (not shown) to facilitate assembly of the decorative lamp. As shown in FIGS. 5-6, the shell 1 includes steps 12 provided on the outer circumferential wall of the shell 1. The number of the steps 12 may be one, two, three or more. The steps 12 may be evenly distributed on the outer circumferential wall of the shell 1 or may be arranged on the outer circumferential wall of the shell 1 in other ways.

Each of the steps 12 includes a clamping face 121 and a positioning face 122 that are connected. An outer surface of the clamping face 121 may be planar or curved with a fixed arc, and may be further provided with a structure, such as a groove or a wave pattern, as long as it may meet requirements for assembly. The outer side structure of the shell 1 is cylindrical, or a truncated cone structure. An angle between the clamping face 121 and the positioning face 122 may be greater than or equal to 90 degrees. Specifically, the width of the positioning face 122 is between 0.3 cm and 1.2 cm, and the optimal width is 0.8 cm in some embodiments.

The illustrated light emitting body 2 is a light emitting diode, such as, an LED lamp. Thus, pins 21 are provided below the light emitting body 2. The diameter of the LED lamp is greater than or equal to 3 mm, and the diameter of 5 mm is preferred. The number of the pins 21 may be two, three or four. In the illustrated embodiments, the light emitting body 2 includes two pins. However, the light emitting body 2 may include additional or fewer pins 21.

The pins 21 are respectively connected to a power supply through the wires 5. Therefore, the pins 21 are respectively connected to the different wires 5. In order to avoid failures due to poor contact or other problems, an isolation means is required to be provided to isolate the different wires 5 and the different pins 21, and at the same time, the isolation means will not jam the pins 21 and/or the wires 5.

In the illustrated embodiment, the isolation means includes an isolation column 4, which is a strip-shaped structure, and is located below the light emitting body 2. The isolation column 4 includes a curved cross-section, in which two opposite side faces are recessed inwards to form two opposite strip-shaped grooves. The strip-shaped groove 41 is provided along a length direction of the isolation column 4. When the isolation column 4 is connected to the light emitting body 2, the pins 21 are respectively inserted into the strip-shaped grooves 41 so as to be separated by the isolation column 4, and the wire 5 connected to the pin 21 is also isolated via the isolation column 4. Additionally, the isolation column 4 fixes the light emitting body 2 within the shell 1 to prevent the light emitting body 2 from falling off from the shell 1.

In some embodiments, an electrical resistor 7 is further provided between the light-emitting body 2 and the wire 5. In other embodiments, the electrical resistor 7 may be omitted, and/or other electrical components may be provided between the light emitting body 2 and the wire 5.

In order to ensure that the isolation column 4 and the light emitting body 2 are firmly mounted within the shell 1, a sealing means is positioned at a lower end of the shell 1. For example, in the illustrated embodiment, the sealing means includes a tail plug 6, and both sides of the tail plug 6 are provided with recesses for the wire 5 to pass through. A size of the tail plug 6 is greater than or equal to the size of the through hole 11, so that the tail plug 6 forms a snug fit with the shell 1. In some embodiments, the shell 1 is elastic (e.g., made of an elastic material such as a flexible plastic material), which facilitates forming a snug fit when the tail plug 6 is inserted into the shell 1. That is, the shell 1 may deform slightly upon insertion of the tail plug 6 into the shell 1.

The tail plug 6 also has a larger diameter or maximum cross-sectional dimension than the isolation column 4. The shell 1 includes an inner wall 14 that acts as a stop when the tail plug 6 is inserted into the shell 1. In addition, the tail plug 6 snugly fits within the through hole 11 of the shell 1 to fix the isolation column 4 to the light emitting body 2 within the shell 1.

In some embodiments, in order to ensure the fixation of the tail plug 6, the inner side wall of the shell 1 may include a protruding ridge 15. The outer side of the tail plug 6 includes a circumferential groove 61 that is recessed inwards. When the tail plug 6 is inserted into the shell 1 along the inner side wall of the shell 1 via the through hole 11, the ridge 15 enters the groove 61 to form a tightly locked structure or snap fit. This prevents the tail plug 6 from slipping out of the through hole 11.

In addition to the light emitting body 2 being fixed through the tail plug 6 and the isolation column 4, the light emitting body 2 may additionally be fixedly connected to the inner side wall of the shell 1 in a tightly matching or adhering manner. To be specific, before the light emitting body 2 and the shell 1 are assembled, glue may be applied to a the outer circumferential side of the light emitting body 2, and then the light emitting body 2 is mounted on the shell 1 to achieve the fixation and mounting of the light emitting body 2.

In order to ensure that the wires 5 will not be jammed by the tail plug 6, the inner side of the shell 1 may be provided with grooves 13 for the wires 5 to pass through and engage. The position of the grooves 13 corresponds to the positions of corresponding grooves 62 in the tail plug 6. That is, when assembled, the grooves 62 and the grooves 13 are each aligned and form circular tracks that receive the respective wires 5.

The wires 5 fit within the grooves 62, 13 when the tail plug 6 is coupled to the mounting shell 1, therefore forming a sealed structure at the end of the decorative lamp, which facilitates waterproofing and air isolation. The snap fit of the tail plug 6 into the mounting shell 1 advantageously provides a strong fastening performance and is convenient for both assembly (e.g., facilitating automatic assembly) while also being able to be disassembled for maintenance.

For manufacturing the decorative lamp as described above, a method of manufacturing a decorative lamp is introduced. The method of manufacturing a decorative lamp in the embodiment comprises the following steps.

Figure 7:
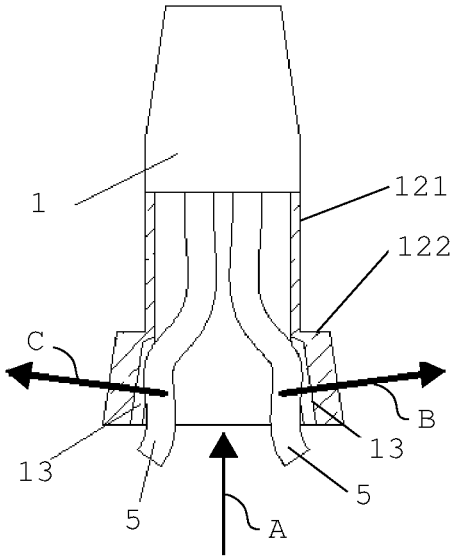
FIG. 7 is a cross-sectional view of the lamp of FIG. 1, illustrating the lamp at a first point in a manufacturing process.
Figure 8:
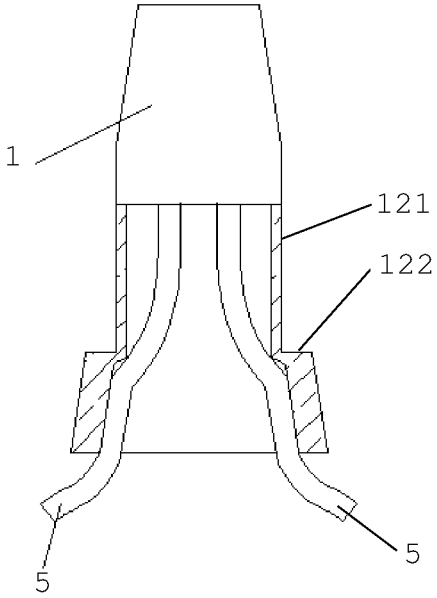
FIG. 8 is another cross-sectional view of the lamp of FIG. 1, illustrating the lamp at a second point in the manufacturing process.

A: placing the mounting shell 1 into a fixture, the steps 12 configured to position and align the mounting shell 1 in the fixture, and the fixture configured to engage the clamping surfaces 121 of the steps 12 to secure the mounting shell 1;

B: welding an exposed part of each pin 21 of the light emitting body 2 to a respective wire 5, and placing the isolation block 4 between the pins 21;

C: inserting the light emitting body 2 in the previous step into the through hole 11 in the rear end of the mounting shell 1, such that the head of the light emitting body 2 protrudes from the front end of the mounting shell 1;

D: aligning the light emitting body 2 and the wires 5 so that the wires 5 fit into the groove 13 in the mounting shell 1;

E: aligning the tail plug 6 so that the groove 62 may match the wire 5, and inserting (e.g., pushing) the tail plug 6 in until the head of the tail plug 6 enters the mounting shell 1;

F: continuing to insert the tail plug 6 into the mounting shell 1, (in the direction of arrow A in FIG. 7, causing the tail plug 6 to push the wires 5 outward (in the direction of arrows B and C) and into the grooves 13 in the mounting shell 1;

G: continuing to insert the tail plug 6 into the mounting shell 1 until the tail plug 6 the ridge 15 engages the groove 61, thereby locking the mounting shell 1 and the tail plug 6 together and securing the light emitting body 2 and the isolation block 4.

It may be seen from the above manufacturing method that in the embodiment, the light emitting body 2 enters from the rear end face of the mounting shell 1, the head of the light emitting body 2 projects out of the front end face of the mounting shell 1, and the lampshade 3 is mounted on the front end face of the mounting shell 1, so the lampshade 3 may be mounted at the same time as any of the above-mentioned steps, or it may be mounted before Step A or after Step G.

In the embodiment, the mounting shell 1, the isolation block 4, the tail plug 6, and the lampshade 3 may be completed by injection molding in advance.

The above embodiment is only a preferred example of the disclosure, and is not intended to limit the scope of implementation of the disclosure, so any equivalent changes or modifications made in accordance with the construction, features, and principles described in the scope of the patent application for disclosure should be included in the scope of the patent application for disclosure.

Various features and aspects of the present disclosure are set forth in the following claims.

What is claimed is:

1. A decorative lamp comprising:

a flexible mounting shell including a first end, a second end opposite the first end, a through hole extending through the first and second ends, a ridge extending into the through hole, and a first plurality of grooves;

a light emitting body positioned at least partially within the flexible mounting shell, wherein a second end of the light emitting body extends from the second end of the flexible mounting shell and a first end of the light emitting body is positioned within the flexible mounting shell; and a tail plug positioned at least partially within the flexible mounting shell adjacent the first end of the flexible mounting shell, the tail plug including a second plurality of grooves, wherein the tail plug has a diameter greater than a diameter of the through hole and is configured to deform the flexible mounting shell upon insertion in the through hole, wherein the first plurality of grooves and the second plurality of grooves are aligned to form tracks configured to receive wires coupled to the first end of the light emitting body, wherein an outer surface of the flexible mounting shell includes a stepped structure, and wherein the flexible mounting shell is configured such that the second end of the light emitting body is installed through the first end of the flexible mounting shell.

2. The decorative lamp of claim 1, further comprising a diffuser coupled to the second end of the flexible mounting shell.

3. The decorative lamp of claim 1, further comprising an isolation column disposed between the first end of the light emitting body and the tail plug.

4. The decorative lamp of claim 3, wherein the light emitting body includes a plurality of pins extending from the first end of the light emitting body and coupled to the wires, and wherein the isolation column includes a third plurality of grooves configured to receive the pins.

5. A method of manufacturing a decorative lamp, comprising:

placing a mounting shell into a fixture, wherein the mounting shell includes a stepped structure;

welding a plurality of wires to a corresponding plurality of pins of a light emitting body;

placing an isolation column between the pins;

inserting the light emitting body into a through hole of the mounting shell, such that a head of the light emitting body protrudes from a second end of the mounting shell;

positioning the light emitting body and the wires such that the wires align with a first plurality of grooves formed in the mounting shell;

positioning a tail plug such that a second plurality of grooves formed in the tail plug is aligned with the wires;

inserting the tail plug into the mounting shell through a first end of the mounting shell;

by inserting the tail plug, pressing the wires into the first plurality of grooves; and further inserting the tail plug until the tail plug and the mounting shell cooperate to form a snap fit.

6. The method of claim 5, wherein a ridge within the mounting shell aligns with and enters a groove on the tail plug to form the snap fit.

7. The decorative lamp of claim 1, wherein the tail plug includes a first end and a second end opposite the first end, wherein the second end of the tail plug faces the first end of the light emitting body, and wherein the tracks extend from the first end of the light emitting body to the first end of the tail plug.

8. The decorative lamp of claim 1, wherein the tail plug includes a circumferential groove, wherein the ridge is configured to engage the groove upon insertion of the tail plug into the flexible mounting shell to secure the tail plug to the flexible mounting shell.

9. The decorative lamp of claim 1, further comprising an isolation column disposed between the first end of the light emitting body and a second end of the tail plug, wherein the tail plug is configured to be inserted into the mounting shell independently of the isolation column.

10. A decorative lamp comprising:

a mounting shell including a first end, a second end opposite the first end, a through hole extending through the first and second ends, and a first plurality of grooves formed in an inner surface of the mounting shell;

a light emitting body having a first end and a second end opposite the first end, wherein the first end of the light emitting body is positioned within the through hole in the mounting shell and the second end of the light emitting body extends from the second end of the mounting shell, and wherein the mounting shell is configured such that the second end of the light emitting body is installed through the first end of the mounting shell;

a plurality of pins coupled to the first end of the light emitting body;

a plurality of wires corresponding and coupled to the plurality of pins;

an isolation column having a first end and a second end opposite the first end, wherein the second end of the isolation column is positioned adjacent the first end of the light emitting body and between the plurality of pins, wherein the isolation column has a second plurality of grooves that extends along an outer surface of the isolation column, wherein the second plurality of grooves extends from the first end of the isolation column to the second end of the isolation column and each groove of the second plurality of grooves is configured to receive one pin of the plurality of pins such that each pin of the plurality of pins is separated from one another; and a tail plug having a first end and a second end opposite the first end, wherein the tail plug is configured to be inserted into the shell independently of the isolation column, wherein the second end of the tail plug is positioned adjacent the first end of the isolation column, the tail plug having a third plurality of grooves that extends along an outer surface of the tail plug from the first end of the tail plug to the second end of the tail plug, each groove of the third plurality of grooves configured to receive one wire of the plurality of wires, wherein the third plurality of grooves is positioned in the tail plug such that each wire of the plurality of wires is separated from the other wires of the plurality of wires, wherein the third plurality of grooves is aligned with both the first plurality of grooves and the second plurality of grooves to form tracks that extend from the first end of the light emitting boy to the first end of the tail plug, wherein the tail plug has a diameter greater than a diameter of the through hole and the first end of the mounting shell is flexible to receive the tail plug, and wherein the tail plug is configured to deform the flexible mounting shell upon insertion of the tail plug into the flexible mounting shell.

11. The decorative lamp of claim 10, wherein the tail plug includes a circumferential groove, and the inner surface of the mounting shell includes a ridge, wherein upon insertion of the tail plug into the mounting shell the ridge is configured to engage the groove to secure the tail plug to the mounting shell.

12. The decorative lamp of claim 10, wherein the tail plug is configured such that upon insertion of the tail plug into the mounting shell, the tail plug pushes the plurality of wires outwardly into the first plurality of grooves of the mounting shell.

13. The decorative lamp of claim 10, further comprising a decorative accessory secured to the second end of the mounting shell, wherein the decorative accessory is selected from the group consisting of: a lampshade, a diffuser, and a decorative piece.

14. The decorative lamp of claim 10, wherein the light emitting body is adhered to the inner wall of the mounting shell.

15. The decorative lamp of claim 10, wherein the tail plug is configured to be inserted into the mounting shell independently of the isolation column.

16. A method of manufacturing a decorative lamp, the method comprising the steps of:

welding a plurality of wires to a corresponding plurality of pins extending from a first end of a light emitting body;

placing an isolation column having a first end and a second end opposite the first end between the pins;

inserting a second end of the light emitting body opposite the first end of the light emitting body through a first end of a shell and into a through hole of the shell, such that the second end of the light emitting body protrudes from a second end of the shell opposite the first end of the shell and the first end of the light emitting body is adjacent the second end of the isolation column;

positioning the light emitting body and the plurality of wires such that the wires align with a first plurality of grooves formed in the shell;

positioning a tail plug having a first end and a second end opposite the first end such that the second end of the tail plug is adjacent the first end of the isolation column and a second plurality of grooves formed in the tail plug is aligned with the plurality of wires to form a plurality of tracks extending from the first end of the light emitting body to the first end of the tail plug;

partially inserting the tail plug into the shell through the first end of the shell to push the plurality of wires into the second plurality of grooves; and further inserting the tail plug into the shell until the tail plug and the shell cooperate to form a snap fit.

17. The method of manufacturing of claim 16, further comprising the step of first placing the shell into a fixture, wherein the mounting shell includes a stepped structure for engagement by the fixture.

18. The method of manufacturing of claim 16, wherein the step of further inserting the tail plug into the shell includes securing a ridge formed on the inner wall of the shell within a circumferential groove formed in an outer wall of the tail plug.

19. The method of manufacturing of claim 16, further comprising the step of attaching a decorative accessory to the second end of the shell prior to the step of inserting the second end of the light emitting body through the first end of the shell and into the through hole of the shell.

20. The method of claim 16, wherein the step of partially inserting the tail plug into the shell flexes the shell outwardly.

* * * * *